US005086803A

United States Patent [19]

Nakajima

[11] Patent Number: 5,086,803

[45] Date of Patent: Feb. 11, 1992

[54] SOLENOID VALVE AND MANIFOLD ASSEMBLY

[75] Inventor: Hiromi Nakajima, Chiba, Japan

[73] Assignee: Taiyo Ltd., Osaka, Japan

[21] Appl. No.: 606,962

[22] Filed: Oct. 31, 1990

[30] Foreign Application Priority Data

Dec. 20, 1989 [JP] Japan ..... 1-328379

[51] Int. Cl.[5] ..... F15B 13/43

[52] U.S. Cl. ..... 137/270; 137/625.64; 137/884

[58] Field of Search ..... 137/270, 625.64, 884

[56] References Cited

U.S. PATENT DOCUMENTS 4,074,689 2/1978 Lenay ..... 137/270

FOREIGN PATENT DOCUMENTS 1-12990 3/1989 Japan .

*Primary Examiner*—Gerald A. Michalsky
*Attorney, Agent, or Firm*—Sughrue, Mion, Zinn, Macpeak & Seas

[57] ABSTRACT

A solenoid valve and manifold assembly wherein a solenoid pilot change-over valve can be selectively used as of the internal pilot type or as of external pilot type. The manifold comprises a gasket capable of being disposed between a manifold body and a valve body of a change-over valve of the solenoid pilot change-over valve alternatively in first or reverse second orientation and having a supply hole, an internal pilot hole and an external pilot hole formed therein. The supply path is communicated with an inlet port of the valve body by way of the supply hole whether the gasket is disposed in the first or second orientation. When the gasket is disposed in the first orientation, the supply path is communicated with a pilot port of the valve body by way of the internal pilot hole while the external pilot hole is displaced from the pilot port and an external pilot path of the manifold body, but when the gasket is disposed in the second orientation, the internal pilot hole is displaced from the supply path and the pilot port while the external pilot path is communicated with the pilot port by way of the external pilot hole.

4 Claims, 11 Drawing Sheets

SOLENOID VALVE AND MANIFOLD ASSEMBLY

BACKGROUND OF THE INVENTION

1. Field of the Invention

This invention relates to a solenoid valve manifold and assembly wherein a solenoid pilot change-over valve including a main or change-over valve having a valve body and a solenoid pilot valve provided on the valve body for controlling the change-over valve is placed on a manifold body.

2. Description of the Prior Art

Conventionally, solenoid pilot change-over valves are divided into two types including an internal pilot type wherein a pressure medium for the pilot operation is supplied from the inside of a change-over valve serving as a main valve into a solenoid pilot valve, and an external pilot type wherein a pressure medium for the pilot operation is supplied separately from the outside of a change-over valve into a solenoid pilot valve. Solenoid pilot change-over valves of the two types are conventionally produced separately from each other.

A solenoid pilot change-over valve of the internal pilot type is disclosed, for example, in Japanese Patent Publication No. 12990/1989. General construction of the conventional solenoid pilot change-over valve is shown in FIG. 12. Referring to FIG. 12, a spool 4 having four pistons 3 thereon is fitted for sliding movement in an axial direction thereof in a valve body 2 of a change-over valve 1 serving as a main valve such that a pair of pilot chambers 5 may be formed adjacent the opposite axial ends of the spool 4. A pair of solenoid pilot valves 6 are provided on the opposite axial outer ends of the valve body 2. In FIG. 12, the change-over valve 1 and solenoid pilot valves 6 are shown integrated with each other for the convenience of illustration.

An inlet port 7 and two outlet ports 8 as well as two exhaust ports 9 are formed in the valve body 1. A plunger 11 is fitted for sliding movement in an axial direction in a plunger chamber 10 of each of the solenoid pilot valves 6, and a solenoid 12 is disposed around each of the plunger chambers 10. Each of the plunger chambers 10 is connected to a corresponding one of the pilot chambers 5 by way of a connecting path 13. A pilot valve seat 15 and an atmosphere communicating valve seat 16 are provided in an opposing relationship to each other in each of the pilot chambers 5. The pilot valve seats 15 are connected to the inlet port 7 by way of a pilot path 14 while the atmosphere communicating valve seats 16 are opened to the atmosphere. Each of the plungers 11 is normally urged toward the corresponding atmosphere communicating valve seat 16 by a sprint 17 so that it normally closes the atmosphere communicating valve seat 16 but opens the pilot valve seat 15 of the corresponding solenoid pilot valve 6. It is to be noted that the pilot path 14 is connected to neither of the two outlet ports 8 and the two exhaust ports 9.

When the solenoid 12 of the left-hand side one in FIG. 12 of the solenoid pilot valves 6 is energized without energizing the solenoid 12 of the other right-hand side solenoid pilot valve 6, the plunger 11 of the left-hand side solenoid pilot valve 6 opens the atmosphere communicating valve seat 16 and closes the pilot valve seat 15 while the plunger 11 of the right-hand side pilot valve 6 opens the pilot valve seat 15 and closes the atmosphere communicating valve seat 16. Accordingly, the right-hand side pilot chamber 5 is communicated with the inlet port 7 by way of the thus open pilot valve seat 15 of the right-hand side solenoid pilot valve 6 and the pilot path 14 so that a pressure medium (compressed air in this instance) is supplied from the inlet port 7 into the right-hand side pilot chamber 5 while the left-hand side pilot chamber 5 is disconnected from the inlet port 7 by the left-hand side plunger 11. Consequently, the spool 4 is displaced leftwardly as seen in FIG. 12. On the contrary if the solenoid 12 of the right-hand side solenoid pilot valve 6 is energized while the solenoid 12 of the left-hand side solenoid pilot valve 6 is not energized, the left-hand side pilot chamber 5 is communicated with the inlet port 7 while the right-hand side pilot chamber 5 is disconnected from the inlet port 7. Consequently, the spool 4 is displaced rightwardly.

FIG. 13 shows an exemplary one of conventional solenoid pilot change-over valves of the external pilot type. Referring to FIG. 13, the solenoid pilot change-over valve shown has generally similar construction to that of the solenoid pilot change-over valve of the internal pilot type of FIG. 12 described just above but is different in that an external pilot port 18 is formed in the valve body 2 and connected to the pilot valve seats 15 of the two solenoid pilot valves 6 by way of the pilot path 14 and a pressure medium for the pilot operation is introduced into the solenoid pilot change-over valve by way of the external pilot port 18 separately from a pressure medium which is alternatively introduced into the solenoid pilot change-over valve by way of the inlet port 7.

In this manner, the conventional solenoid pilot change-over valve of the internal pilot type and the conventional solenoid pilot change-over valve of the external pilot type are different from each other in structure of the change-over valve serving as a main valve, and accordingly, they are conventionally produced separately as solenoid pilot change-over valves for the individual exclusive use, which, however, is uneconomical. Also in use, particularly where a comparatively large number of solenoid pilot change-over valves are installed on a manifold and used at a time, in the case of the solenoid pilot change-over valve of the external pilot type, a pipe for the supply of external pilot pressure must be connected to each of the solenoid pilot change-over valves. Consequently, the cost for such pipes is high, and besides, such pipes are complicated in arrangement.

SUMMARY OF THE INVENTION

It is an object of the present invention to provide a solenoid valve manifold wherein a solenoid pilot change-over valve can be selectively used as a solenoid pilot change-over valve of the internal pilot type or a solenoid pilot change-over valve of the external pilot type.

It is another object of the present invention to provide a solenoid valve manifold wherein each of a large number of solenoid pilot change-over valves can be selectively used as a solenoid pilot change-over valve of the internal pilot type or a solenoid pilot change-over valve of the external pilot type and, when the solenoid pilot change-over valves are used as solenoid pilot change-over valves of the external pilot type, an external pilot pressure can be supplied from the manifold at a time to the solenoid pilot change-over valves.

In order to attain the objects, according to the present invention, a solenoid valve and manifold assembly comprises a manifold body, and a solenoid pilot change-over valve placed on the manifold body and including a change-over valve having a valve body and a solenoid pilot valve provided on the valve body for controlling the change-over valve. The manifold body has at least a supply path and an external pilot path formed therein while the valve body of the change-over valve serving as a main valve has formed therein at least an inlet port and a pilot port which is communicated with the solenoid pilot valve. The solenoid valve manifold further comprises a gasket capable of being disposed between the manifold body and the valve body alternatively in first orientation or in second orientation reverse to the first orientation and having at least a supply hole, an internal pilot hole and an external pilot hole formed therein such that an exit of the supply path of the manifold body is communicated with the inlet port of the valve body by way of the supply hole whether the gasket is disposed between the manifold body and the valve body in the first orientation or in the second orientation; the exit of the supply path is communicated with the pilot port by way of the internal pilot hole when the gasket is disposed in the first orientation, but when the gasket is disposed in the second orientation, the internal pilot hole is displaced from the exit of the supply path and the pilot port; and the external pilot hole is displaced from the pilot port and an exit of the external pilot path when the gasket is disposed in the first orientation, but when the gasket is disposed in the second orientation, the exit of the external pilot path is communicated with the pilot port by way of the external pilot hole.

The supply hole and the internal pilot hole may be formed continuously to each other in the gasket.

The valve body may further have an outlet port formed therein while the manifold body may further have an output path formed therein, and the gasket may further have an output hole formed therein. In this instance, whether the gasket is disposed in the first orientation or in the second orientation, the outlet port and an entrance of the output path are communicated with each other by way of the output hole.

The valve body may further have an exhaust port formed therein while the manifold body may further have an exhaust path formed therein, and the gasket may further have an exhaust hole formed therein. In this instance, whether the gasket is disposed in the first orientation or in the second orientation, the exhaust port and an entrance of the exhaust path are communicated with each other by way of the exhaust hole.

When the solenoid pilot change-over valve, manifold body and gasket are to be assembled, if the gasket is mounted in the first orientation, then the inlet port of the solenoid pilot change-over valve is communicated with the supply path while the pilot port is also communicated with the supply path, and consequently, the solenoid pilot change-over valve is formed as a solenoid pilot change-over valve of the internal pilot type.

On the contrary if the gasket is mounted in the second orientation, then the inlet port of the solenoid pilot change-over valve is communicated with the supply path of the manifold body while the pilot port is communicated with the external pilot path of the manifold body, and consequently, the solenoid pilot change-over valve is formed as a solenoid pilot change-over valve of the external pilot type.

In this manner, the solenoid pilot change-over valve of the same structure can be used alternatively as a solenoid pilot change-over valve of the internal pilot type or the external pilot type only by reversing the orientation of the gasket disposed between the solenoid pilot change-over valve and the manifold body, which is economical. Further, where the solenoid pilot change-over valve is used as a solenoid pilot change-over valve of the external pilot type, since an external pilot pressure can be supplied from the manifold body at a time into a plurality of such solenoid pilot change-over valves, an equipment of pipes can be simplified as compared with a conventional equipment.

The above and other objects, features and advantages of the present invention will become apparent from the following description and the appended claims, taken in conjunction with the accompanying drawings.

DESCRIPTION OF THE PREFERRED EMBODIMENTS

Referring first to FIGS. 1*a*, 1*b* and 2*a*, 2*b*, there is shown a magnet valve manifold of a first embodiment of the present invention which is assembled as a magnet valve manifold of the internal pilot type and the external pilot type, respectively. The magnet valve manifold shown includes a valve body 20 of a change-over valve serving as a main valve of a solenoid pilot change-over valve and placed on a manifold body 22 generally in the form of a rectangular block by way of a gasket 21 generally in the form of a plate. A plurality of such manifold bodies 22 are disposed in a juxtaposed relationship and joined together to each other as shown in solid lines and in phantom in FIG. 1*a*.

Figure 3A:
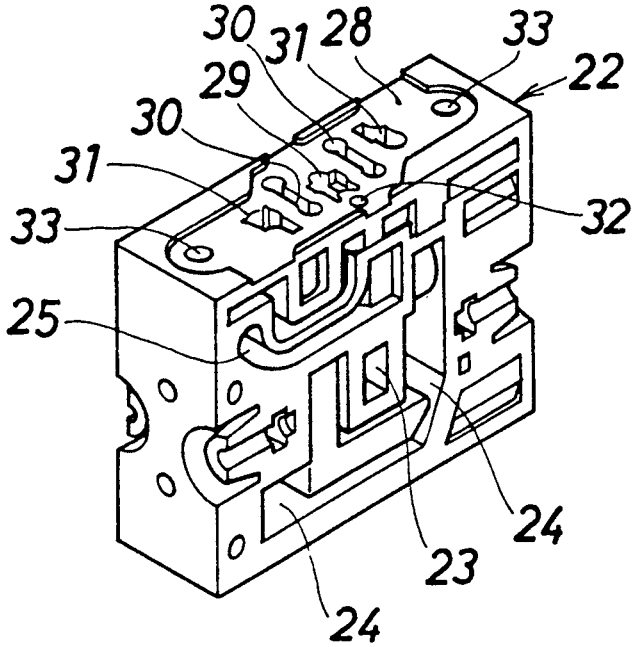
FIGS. 3*a* and 3*b* are perspective views of the manifold body of the solenoid valve manifold of FIG. 1 as viewed in the opposite directions.
Figure 3B:
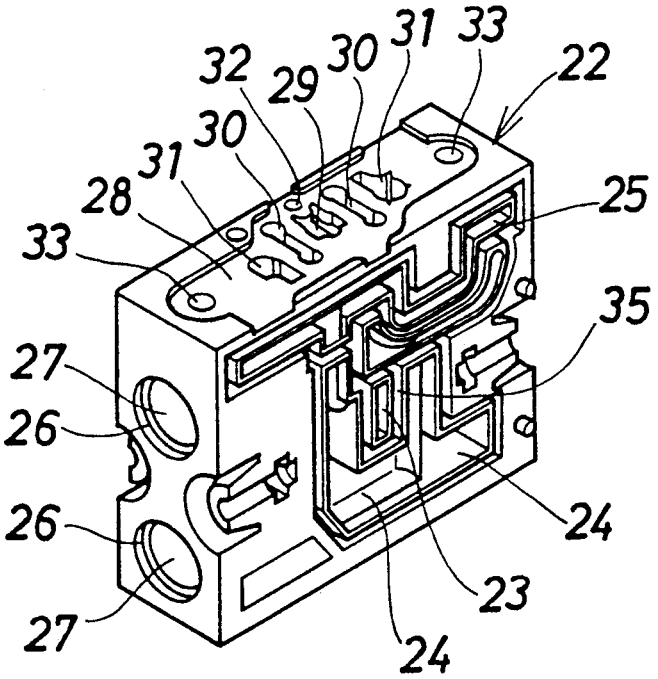

Referring to FIGS. 3*a* and 3*b*, the manifold body 22 is shown in perspective views as viewed from the opposite sides thereof. The manifold body 22 is formed by integral molding of a hard synthetic resin material and has formed therein a supply path 23 which is opened to the opposite side faces defining a width or thickness of the manifold body 22, a pair of exhaust paths 24 which are also opened to the opposite side faces of the manifold body 22, an external pilot path 25 which is similarly opened to the opposite side faces of the manifold body 22, and a pair of output paths 27 each of which has an exit 26 opened at an end face of the manifold body 22. The manifold body 22 further has a shallow recess 28 formed on an upper face thereof so that the plate-formed gasket 21 may be fitted closely therein. When the manifold body 22 is joined to another manifold body 22 of the same structure, the supply path 23 thereof is connected in series to the supply path 23 of the second manifold body 22, and the exhaust paths 24 and external pilot paths 25 are also connected in series to each other, respectively.

Accordingly, a pressure medium can be supplied at a time into the supply paths 23 of a plurality of such manifold bodies 22 which are joined together to each other, and also a pressure medium can be separately supplied at a time into the external pilot paths 25 of the mutually joined manifold bodies 22 while such pressure medium can be exhausted in a concentrated manner from the exhaust paths 24 of the manifold bodies 22. Flows of a pressure medium from the two output paths 27 are discharged separately from each other from the two exits 26 for each of the manifold bodies 22.

In each of the manifold bodies 22, an exit 29 of the supply path 23 is opened at a central location of the area of the recess 28: entrances 30 of the two output paths 27 are opened on the opposite sides of the exit 29: entrances 31 of the two exhaust paths 24 are opened separately on the opposite further outer sides of the entrances 30: and an exit 32 of the external pilot path 25 is opened in the proximity of the exit 29 of the supply path 23. Further, a pair of positioning holes 33 for positioning the valve body 20 are formed at the opposite end portions of the area of the recess 28. In addition, a groove 35 is formed on one side face of the manifold body 22 for fitting therein a seal member 34 (FIG. 1*a*) for sealing connecting portions of the supply path 23, exhaust paths 24 and external pilot path 25 of the manifold body 22 to those of an adjacent manifold body 22.

Figure 4A:
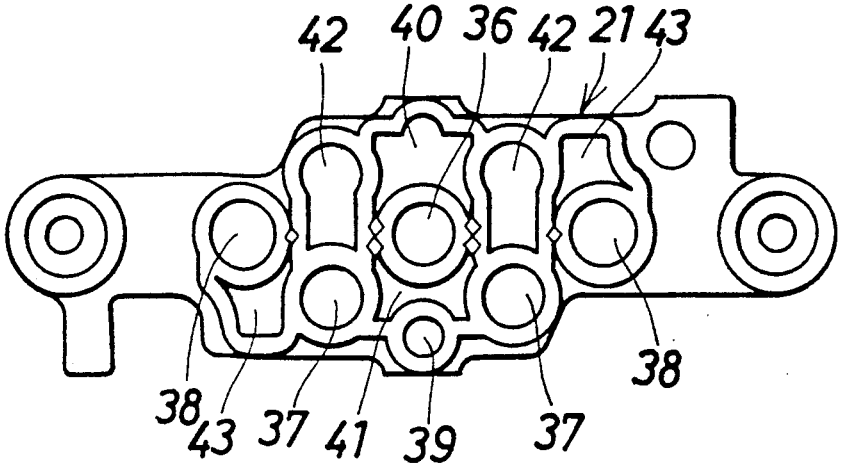
FIGS. 4*a* and 4*b* are a plan view and a longitudinal sectional view, respectively, of the gasket of the solenoid valve manifold of FIG. 1*a;*
Figure 4B:
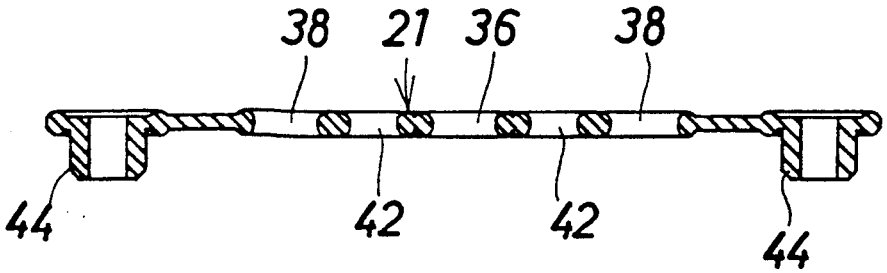

Referring now to FIGS. 4*a* and 4*b*, the gasket 21 for use with the solenoid valve manifold of the first embodiment is shown in a plan view and a central sectional view, respectively. The gasket 21 has formed therein a supply hole 36 which corresponds to the entrance 29 of the supply path 23 of the manifold body 22, a pair of output holes 37 which corresponds to the entrances 30 of the two output paths 27, a pair of exhaust holes 38 corresponding to the entrances 31 of the two exhaust paths 24, and an external pilot hole 39 which corresponds to the exit 32 of the external pilot path 25. The holes 36 to 39 of the gasket 21 all have a circular shape in plan as seen in FIG. 4*a*. The gasket 21 further has an internal pilot hole 40 formed therein on the opposite side of the external pilot hole 39 with respect to the supply hole 36, and further has auxiliary holes 41, 42 and 43 formed therein corresponding to the supply hole 36, two output holes 37 and two exhaust holes 38, respectively. A lip which is fattened in thickness on the opposite upper and lower faces of the gasket 21 is formed along a peripheral edge of each of the holes 36 to 43. Further, a pair of bosses 44 for fitting in the positioning holes 33 at the opposite end portions of the manifold body 22 are formed integrally at the opposite ends of the lower face of the gasket 21.

Referring back to FIG. 1*a*, the valve body 20 has an inlet port 45 and a pilot port 46 formed on a lower face thereof and further has, though not shown, a pair of outlet ports and a pair of exhaust ports formed on the lower face thereof. The inlet port 45 and the pilot port 46 are provided corresponding to the exit 29 of the supply path 23 and the exit 32 of the external pilot path 25, respectively, of the manifold body 22. Similarly, the two outlet ports and the two exhaust ports not shown of the valve body 20 are provided corresponding to the entrances 30 of the two output paths 27 and the entrances 31 of the two exhaust paths 24, respectively, of the manifold body 22. Though not shown, a pair of solenoid pilot valves are provided at one end or the opposite ends of the valve body 20 in a similar manner as in the conventional solenoid valve manifold described hereinabove, and the pilot port 46 is connected to pilot valve seats (not shown) of the solenoid pilot valves by way of paths (not shown) formed in the valve body 20.

Figure 1A:
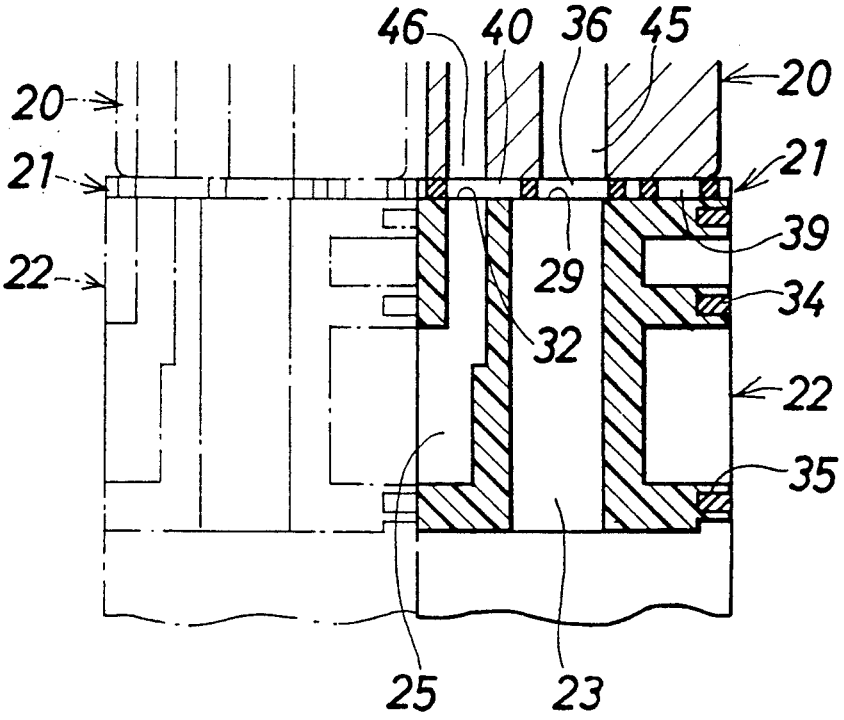
FIG. 1*a* is a central sectional view of a solenoid valve manifold assembled as a solenoid valve manifold of the internal pilot type showing a first embodiment of the present invention.
Figure 1B:
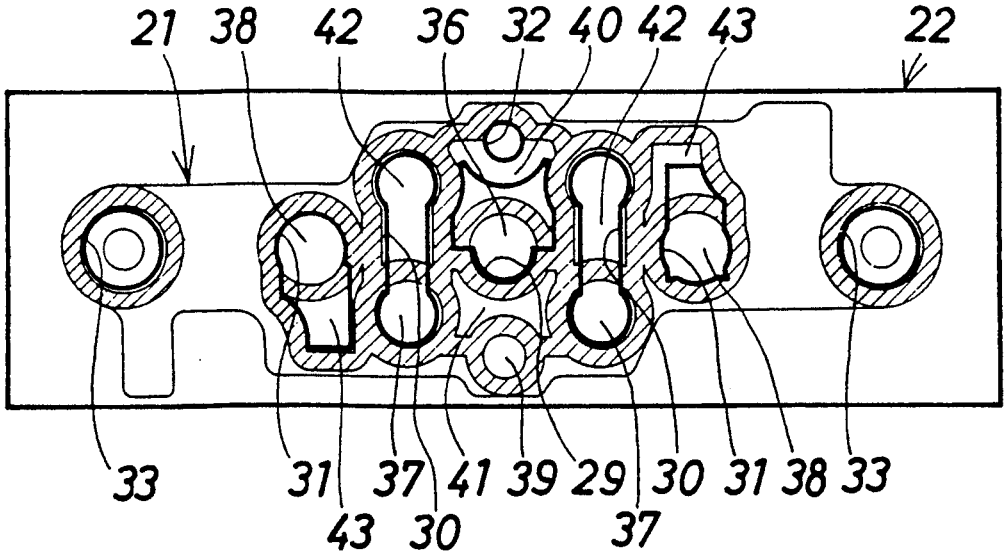
FIG. 1*b* is a cross sectional plan view of the solenoid valve manifold of FIG. 1*a* illustrating a relationship between a manifold body and a gasket.
Figure 2A:
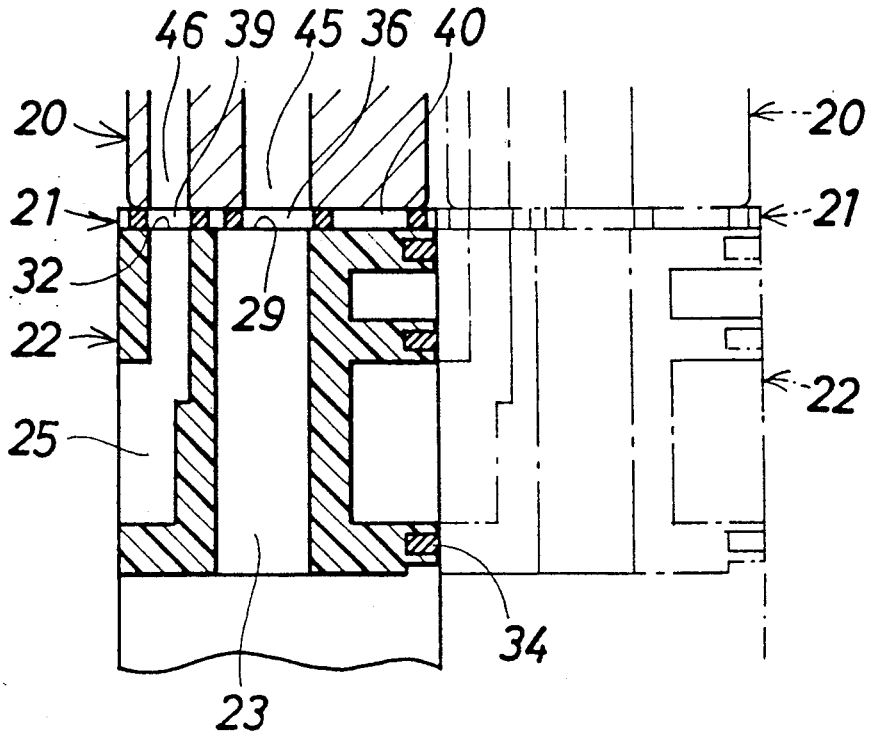
FIG. 2*a* is a central sectional view of the solenoid valve manifold of FIG. 1*a* but assembled as a solenoid valve manifold of the external pilot type.

With the solenoid valve manifold of the first embodiment, the solenoid pilot change-over valve thereof can be made alternatively as a solenoid pilot change-over valve of the external pilot type or as a solenoid pilot change-over valve of the internal pilot type by orienting, upon assembly, the gasket 21 in either one of directions different by 180 degrees from each other in a plane thereof as shown in FIGS. 1*a* and 2*a* in the following manner. It is to be noted that the hatched portions of FIGS. 1*b* and 2*b* indicate the lips around the holes 36 to 43 of the gasket 21.

Where the gasket 21 is oriented as seen in FIG. 1*b*, the supply hole 36 thereof is opposed to and communicated with the exit 29 of the supply path 23 of the manifold body 22 and the inlet port 45 of the valve body 20 as seen in FIG. 1*a*, but the external pilot hole 39 is located on the opposite side of and disconnected from the exit 32 of the external pilot path 25 of the manifold body 22 and the pilot port 46 of the valve body 20 with respect to the supply hole 36. In this condition, the two output holes 37 are opposed to and communicated with the entrances 30 of the two output paths 27 of the manifold body 22 and the two outlet ports of the valve body 20, and also the two exhaust holes 38 are opposed to and communicated with the entrances 31 of the two exhaust paths 24 of the manifold body 22 and the two exhaust ports of the valve body 20. Further, the exit 29 of the supply path 23 has a size sufficient to allow the same to be communicated with both of the supply hole 36 and the internal pilot hole 40 while the internal pilot hole 40 is communicated also with the pilot port 46 of the valve body 20, and consequently, the exit 29 of the supply path 23 and the pilot port 46 are communicated with each other with a sufficiently great area.

Accordingly, a pressure medium (compressed air in this instance) from the supply path 23 of the manifold body 22 is introduced into the inlet port 45 of the valve body 20 by way of the exit 29 of the supply path 23 and the supply hole 36 of the gasket 21 and also into the pilot port 46 of the valve body 20 by way of the exit 29 of the supply path 23 and the internal pilot hole 40 of the gasket 21. Accordingly, the solenoid pilot change-over valve on the manifold body 22 is formed as a solenoid pilot change-over valve of the internal pilot type. It is to be noted that the internal pilot hole 40 is opposed also to the exit 32 of the external pilot path 25 of the manifold body 22 so that a pressure medium from the supply path 23 is introduced also into the external pilot path 25. Thus, when the solenoid pilot change-over valve is to be used as a solenoid pilot change-over valve of the internal pilot type, the entrance of the external pilot path 25 of each of those of a plurality of such manifold bodies 22 disposed in a mutually joined, juxtaposed relationship to each other which are located on the opposite sides of the manifold bodies 22 is closed in advance.

Figure 2B:
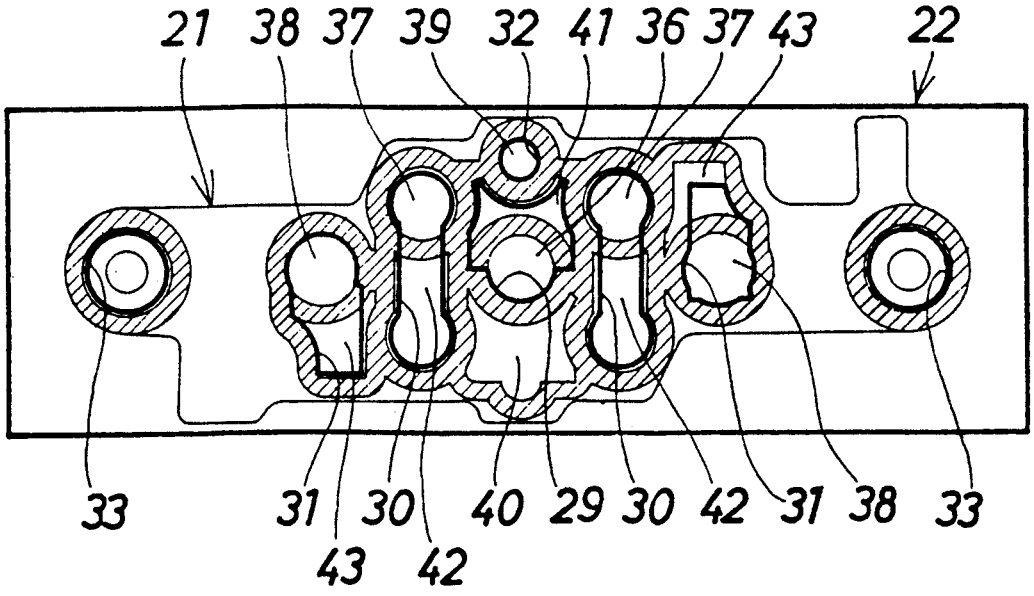
FIG. 2*b* is a cross sectional plan view illustrating a relationship between the manifold body and the gasket of the solenoid valve manifold in the condition shown in FIG. 2*a;*

On the other hand, when the gasket 21 is assembled in such orientation as seen in FIG. 2*b*, the supply hole 36 thereof is opposed to and communicated with the exit 29 of the supply path 23 of the manifold body 22 and the inlet port 45 of the valve body 20, and the external pilot hole 39 is also opposed to and communicated with the exit 32 of the external pilot path 25 of the manifold body 22 and the pilot port 46 of the valve body 20, but the internal pilot hole 40 is displaced from the exit 29 of the supply hole 23 and the exit 32 of the external pilot path 25 as seen in FIG. 2*a*. In this instance, the two output holes 37 of the gasket 21 are opposed to and communicated with the two entrances 30 of the manifold body 22 and the two outlet ports of the valve body 20, although the positions are different from those in the condition of FIG. 1*b*, because the two entrances 30 of the output paths 27 of the manifold body 22 are elongated sufficiently in a widthwise direction of the manifold body 22, that is, in the upward and downward directions in FIG. 2*b*. Further, the two exhaust holes 38 of the gasket 21 are opposed to and communicated with the entrances 31 of the two exhaust paths 24 of the manifold body 22 and the two exhaust ports of the valve body 20.

Accordingly, a pressure medium from the supply path 23 of the manifold body 22 is introduced into the inlet port 45 of the valve body 20 by way of the exit 29 of the supply path 23 and the supply hole 36 of the gasket 21 while a pressure medium from the external pilot path 25 of the manifold body 22 is introduced into the pilot port 46 of the valve body 20 by way of the exit 32 of the external pilot path 25 and the external pilot hole 39 of the gasket 21. Accordingly, the solenoid pilot change-over valve on the manifold body 22 is formed as a solenoid pilot change-over valve of the external pilot type.

Whether the solenoid pilot change-over valve is formed as of the internal pilot type or the external pilot type, flows of a pressure medium from the two outlet ports of the solenoid pilot change-over valve are exhausted from the exits 26 of the two output paths 27 of the manifold body 22 while flows of a pressure medium from the two exhaust ports of the solenoid pilot change-over valve are exhausted in a concentrated manner from the exhaust paths 24 communicated with each other.

Referring now to FIGS. 5*a*, 5*b* and 6*a*, 6*b*, there is shown a solenoid valve manifold of the second embodiment of the present invention which is shown assembled as a solenoid valve manifold of the internal pilot type and a solenoid valve manifold of the external pilot type, respectively.

A manifold body 22*a* of the solenoid valve manifold of the second embodiment is substantially similar in structure to the manifold body 22 of the solenoid valve manifold of the first embodiment described above, but is different in that, since a gasket 21*a* which is to be combined with the manifold body 22*a* is different in shape from the gasket 21 of the solenoid valve manifold of the first embodiment, the recess 28 at the upper face, the exit 29 of the supply path 23, the entrances 30 of the two output paths 27 and the entrances 31 of the two exhaust paths 24 thereof are different a little from those of the manifold body 22 of the solenoid valve manifold of the first embodiment.

In the gasket 21*a* of the solenoid valve manifold of the second embodiment, the supply hole 36 and the internal pilot hole 40 which are provided separately from each other in the gasket 21 of the solenoid valve manifold of the first embodiment is formed as a single continuous hole. Further, the gasket 21*a* has no bosses corresponding to the bosses 44 of the gasket 21 in the first embodiment, and besides it has no auxiliary hole corresponding to the auxiliary hole 41 for the communication with the supply hole 36. However, the gasket 21*a* has lips formed thereon around the individual holes formed therein.

In the solenoid valve manifold of the second embodiment, a selection between the internal pilot type and the external pilot type is made by turning over the gasket 21*a* upside down.

Figure 5A:
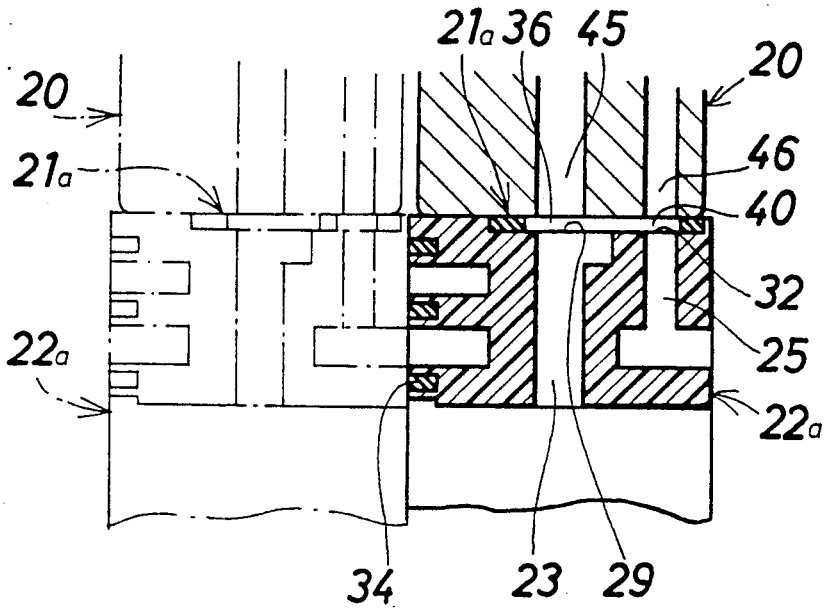
FIG. 5*a* is a central sectional view of a solenoid valve manifold assembled as a solenoid valve manifold of the internal pilot type showing a second embodiment of the present invention.
Figure 5B:
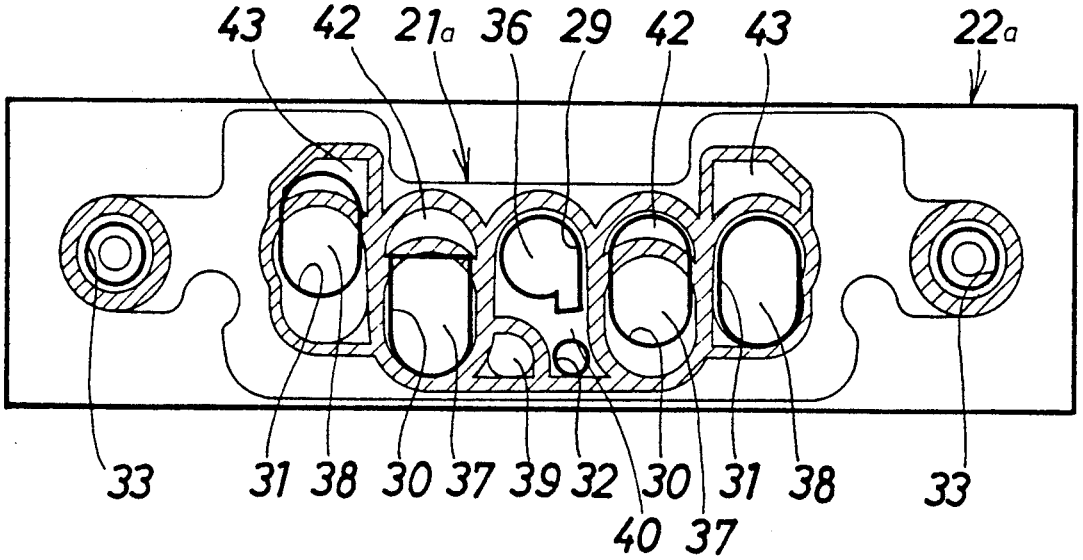
FIG. 5*b* is a cross sectional plan view of the solenoid valve manifold of FIG. 5*a* illustrating a relationship between a manifold body and a gasket.
Figure 6A:
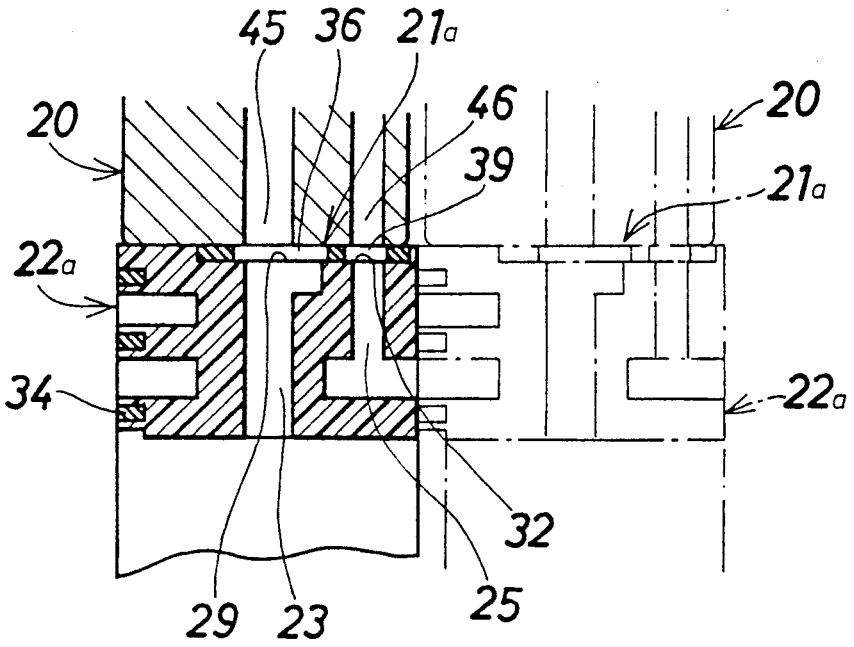
FIG. 6*a* is a central sectional view of the solenoid valve manifold of FIG. 5*a* but assembled as a solenoid valve manifold of the external pilot type.
Figure 6B:
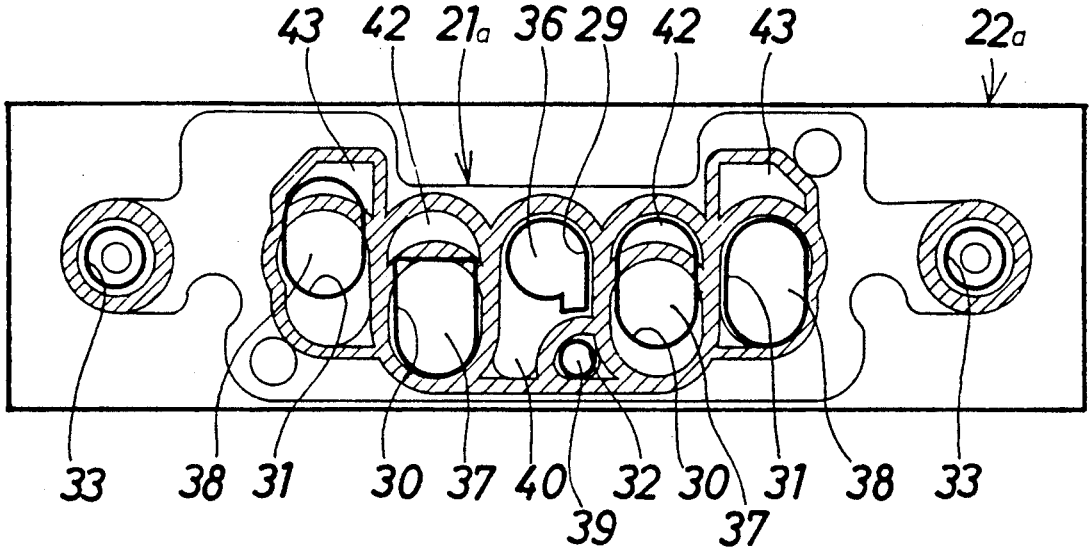
FIG. 6*b* is a cross sectional plan view illustrating a relationship between the manifold body and the gasket of the solenoid valve manifold in the condition shown in FIG. 6*a;*
Figure 7:
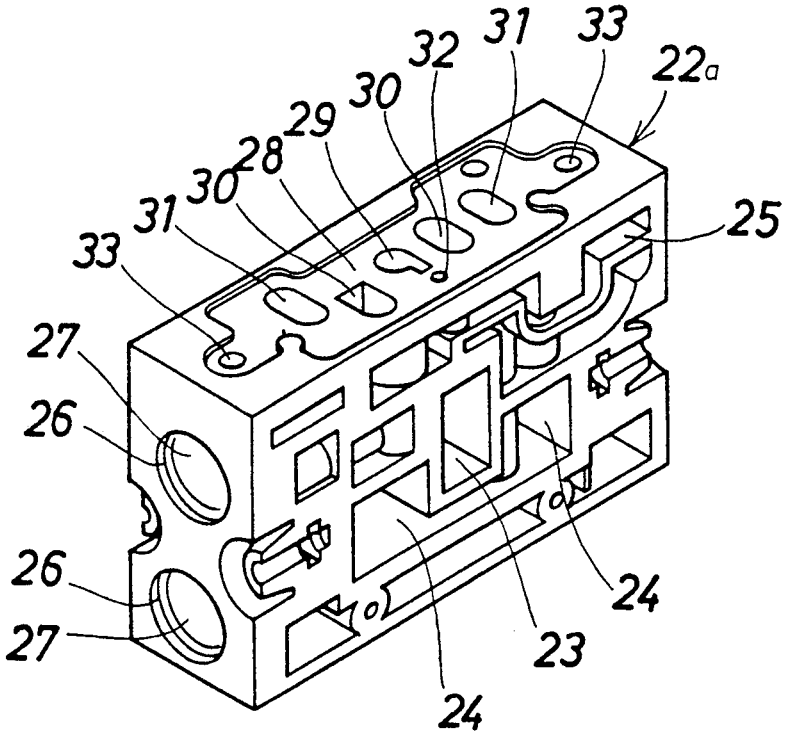
FIG. 7 is a perspective view of the manifold body of the solenoid valve manifold of FIG. 5*a;*
Figure 8A:
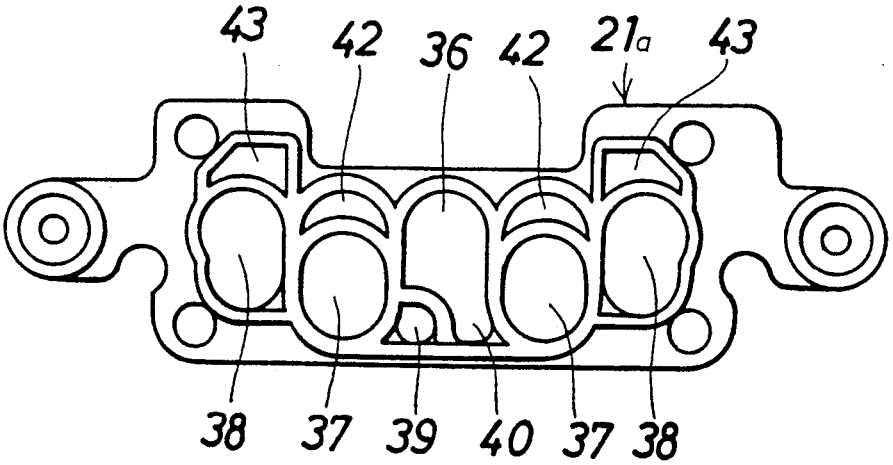
FIGS. 8*a* and 8*b* are a plan view and a longitudinal sectional view, respectively of the gasket of the solenoid valve manifold of FIG. 5*a;*
Figure 8B:
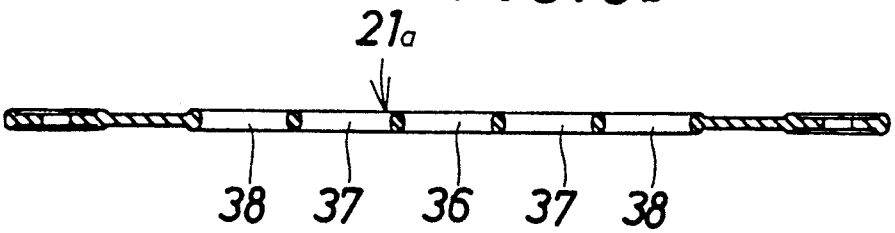

In particular, where the gasket 21*a* is disposed between the valve body 20 and the manifold body 22*a* in such orientation as shown in FIGS. 5*a* and 5*b*, the supply hole 36 thereof is opposed to and communicated with the exit 29 of the supply path 23 of the manifold body 22*a* and the inlet port 45 of the valve body 20, and the internal pilot hole 40 continuous with the supply hole 36 is communicated with the pilot port 46 of the valve body 20, but the external pilot hole 39 is displaced from the exit 32 of the external pilot path of the manifold body 22*a*. In this instance, the two output holes 37 and two exhaust holes 38 are in individually similar conditions as those of the solenoid valve manifold of the first embodiment described above. Accordingly, the solenoid pilot change-over valve is formed as a solenoid pilot change-over valve of the internal pilot type.

Where the gasket 21*a* is disposed between the valve body 20 and the manifold body 22*a* in turned over orientation as shown in FIGS. 6*a* and 6*b*, the supply hole 36 is communicated with the exit 29 of the supply path of the manifold body 22*a* and the inlet port 45 of the valve body 20, and the external pilot hole 39 is communicated with the exit 32 of the external pilot path 25 of the manifold body 22*a* and the pilot port 46 of the valve body 20, but the internal pilot hole 40 is displaced from the exit 32 of the external pilot path 25 and the pilot port 46. Accordingly, in this instance, the solenoid pilot change-over valve is formed as a solenoid pilot change-over valve of the external pilot type.

Figure 9A:
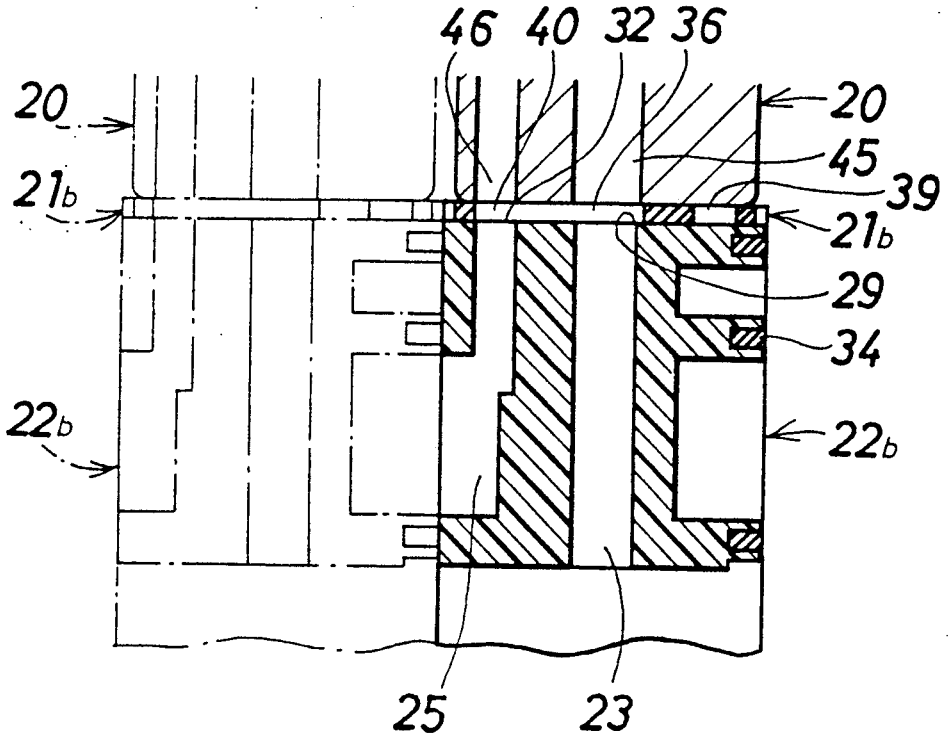
FIG. 9*a* is a central sectional view of a solenoid valve manifold assembled as a solenoid valve manifold of the internal pilot type showing a third embodiment of the present invention.
Figure 9B:
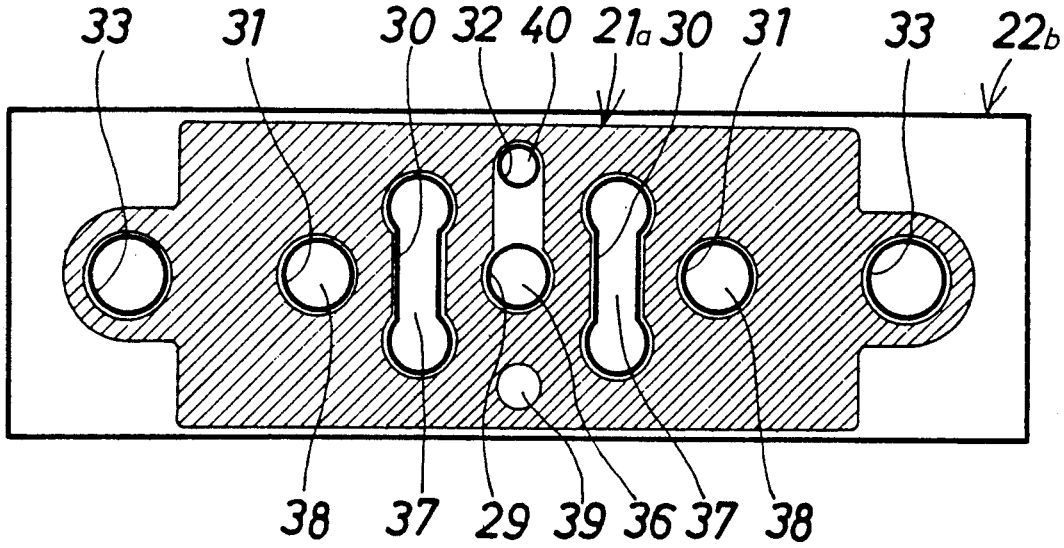
FIG. 9*b* is a cross sectional plan view of the solenoid valve manifold of FIG. 5*a* illustrating a relationship between a manifold body and a gasket.
Figure 10A:
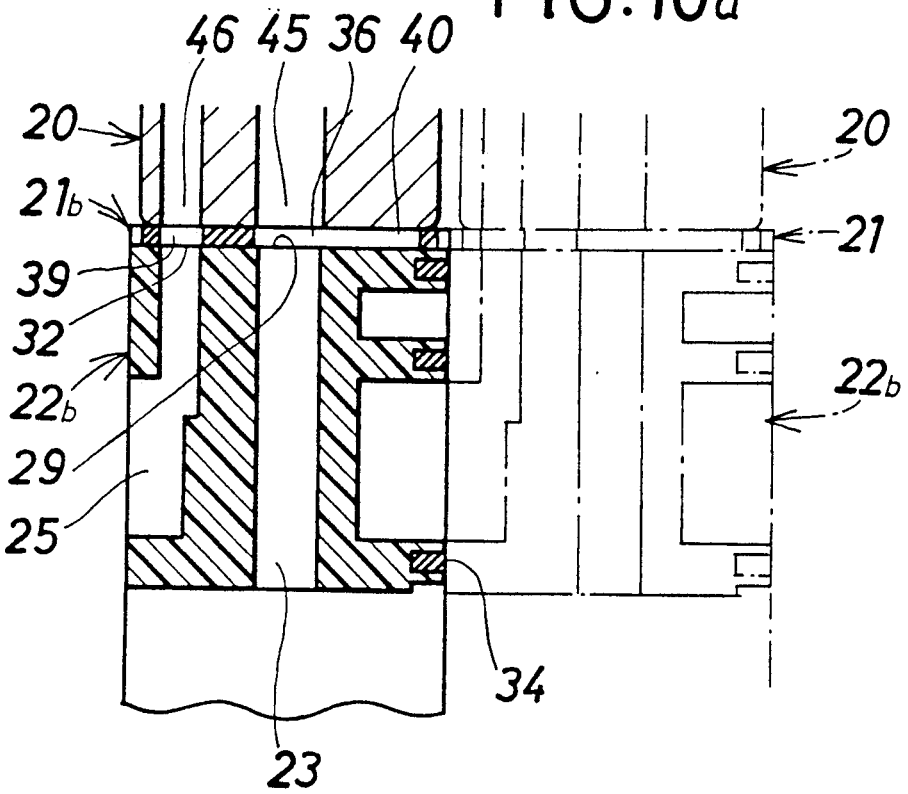
FIG. 10*a* is a central sectional view of the solenoid valve manifold of FIG. 9*a* but assembled as a solenoid valve manifold of the external pilot type.
Figure 10B:
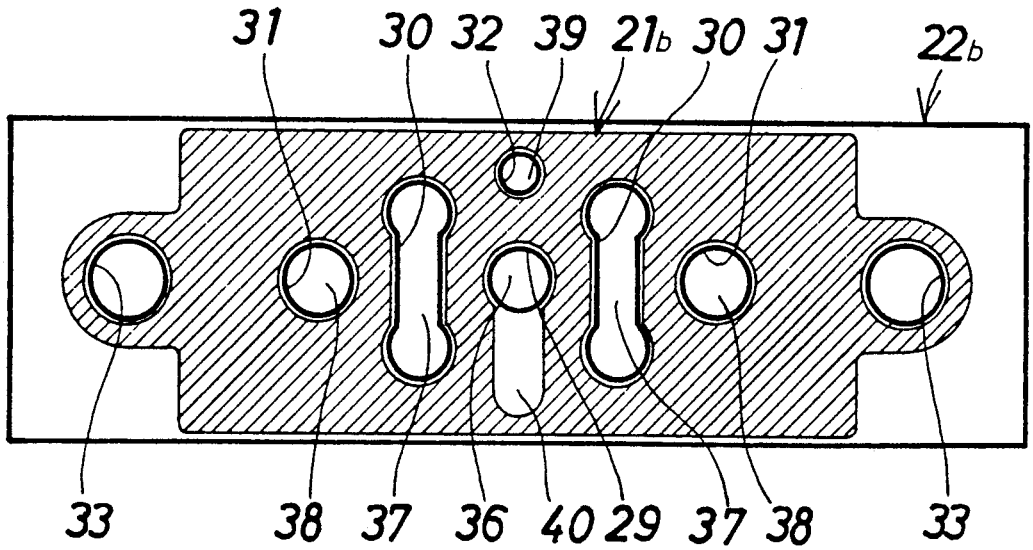
FIG. 10*b* is a cross sectional plan view illustrating a relationship between the manifold body and the gasket of the solenoid valve manifold in the condition shown in FIG. 10*a;*
Figure 11:
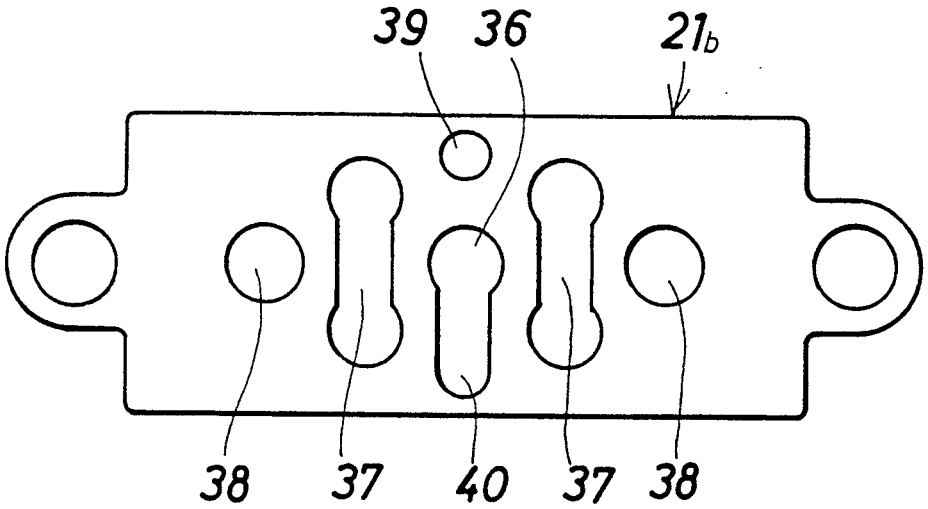
FIG. 11 is a plan view of the manifold body of the solenoid valve manifold of FIG. 9*a;*
Figure 12:
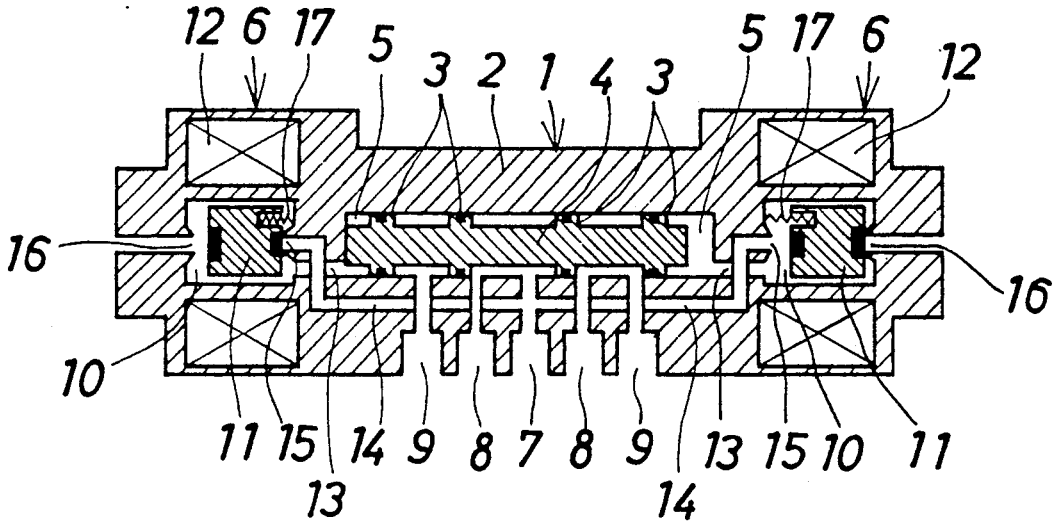
FIG. 12 PRIOR ART
FIG. 12 is a schematic sectional view of a conventional solenoid pilot change-over valve of the internal pilot type.
Figure 13:
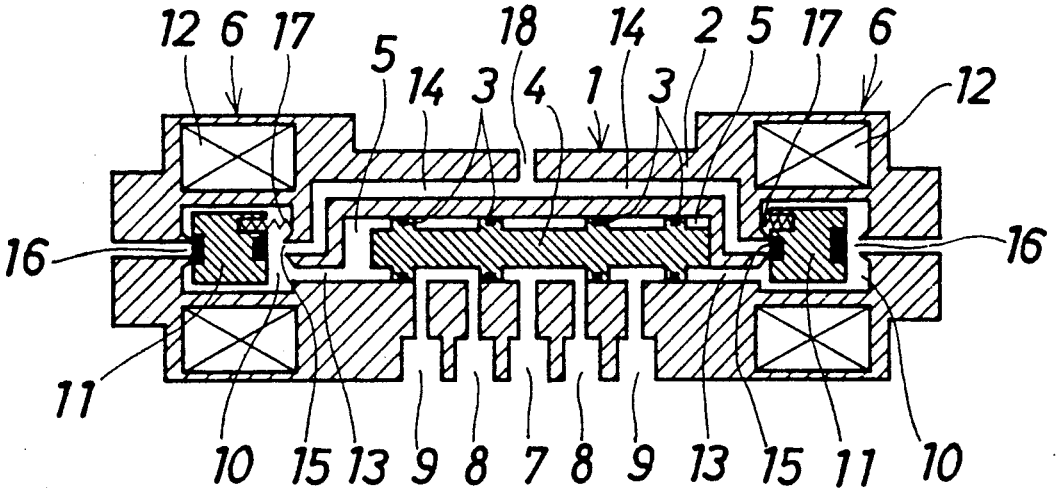
FIG. 13 PRIOR ART
FIG. 13 is a similar view but showing another conventional solenoid pilot change-over valve of the external pilot type.

FIGS. 9*a*, 9*b* and 10*a*, 10*b* show a solenoid valve manifold of the third embodiment of the present invention which is shown assembled as a solenoid valve manifold of the internal pilot type and a solenoid valve manifold of the external pilot type, respectively, and FIG. 11 shows a gasket employed in the solenoid valve manifold. Referring to FIGS. 9*a*, 9*b*, 10*a*, 10*b* and 11, in the case of the solenoid valve manifold of the third embodiment, a selection between the internal pilot type and the external pilot type is performed either by rotating the gasket 21*b* by 180 degrees in its plane or by turning over the gasket 21*b* with its upside down. To this end, the supply hole 36 is provided at the center of the gasket 21*b*; the internal pilot hole 40 is formed continuously with the supply hole 36; and the external pilot hole 39 is provided on the opposite side of the internal pilot hole 40 with respect to the supply hole 36. The entire gasket 22*b* has the form of a mere plate having no lips formed around the holes thereof. The manifold body 22*b* of the solenoid valve manifold of the third embodiment is substantially similar in internal structure thereof to that of the manifold body 22 of the solenoid valve manifold of the first embodiment, and the exit 29 of the supply path, entrances 30 of the two output paths, entrances 31 of the two exhaust paths and exit 32 of the external pilot path have similar shapes to those of the corresponding holes of the gasket 21*b*.

Where the gasket 21*b* is disposed between the valve body 20 and the manifold body 22*b* in such orientation as seen in FIGS. 9*a* and 9*b*, the supply hole 36 is opposed to and communicated with the exit 29 of the supply path 23 of the manifold body 22*b* and the inlet port 45 of the valve body 20, and the internal pilot hole 40 continuous with the supply hole 36 is communicated with the pilot port 46 of the valve body 20, but the external pilot hole 39 is displaced from the exit 32 of the external pilot path 25 of the manifold body 22*b*. The two output holes 37 and the two exhaust holes 38 are individually in similar conditions to those described hereinabove. Accordingly, in this instance, the solenoid pilot change-over valve is formed as a solenoid pilot change-over valve of the internal pilot type.

If the gasket 21*b* is either rotated by 180 degrees in its plane or is turned over with its upside down in such orientation as seen in FIGS. 10*a* and 10*b* and disposed between the valve body 20 and the manifold body 22*b*, then the supply hole 36 is communicated with the exit 29 of the supply path 23 of the manifold body 22*b* and the inlet port 45 of the valve body 20, and the external pilot hole 39 is communicated with the exit 32 of the external pilot path 25 of the manifold body 22 and the pilot hole 46 of the valve body 20, but the internal pilot hole 40 is displaced from the exit 32 of the external pilot path 25 and the pilot port 46. Accordingly, in this instance, the solenoid pilot change-over valve is formed as a solenoid pilot change-over valve of the external pilot type.

Having now fully described the invention, it will be apparent to one of ordinary skill in the art that many changes and modifications can be made thereto without departing from the spirit and scope of the invention as set forth herein.

What is claimed is:

1. A solenoid valve and manifold assembly, comprising a manifold body, a solenoid pilot change-over valve placed on said manifold body and including a change-over valve having a valve body and a solenoid pilot valve provided on said valve body for controlling said change-over valve, said manifold body having at least a supply path and an external pilot path formed therein, said valve body having formed therein at least an inlet port and a pilot port which is communicated with said solenoid pilot valve, and a gasket capable of being disposed between said manifold body and said valve body alternatively in first orientation or in second orientation reverse to the first orientation and having at least a supply hole, an internal pilot hole and an external pilot hole formed therein such that an exit of said supply path of said manifold body is communicated with said inlet port of said valve body by way of said supply hole whether said gasket is disposed between said manifold body and said valve body in the first orientation or in the second orientation; said exit of said supply path is communicated with said pilot port by way of said internal pilot hole when said gasket is disposed in the first orientation, but when said gasket is disposed in the second orientation, said internal pilot hole is displaced from said exit of said supply path and said pilot port; and said external pilot hole is displaced from said pilot port and an exit of said external pilot path when said gasket is disposed in the first orientation, but when said gasket is disposed in the second orientation, said exit of said external pilot path is communicated with said pilot port by way of said external pilot hole.

2. A solenoid valve manifold as claimed in claim 1, wherein said supply hole and said internal pilot hole are formed continuously with each other in said gasket.

3. A solenoid valve manifold as claimed in claim 1, wherein said valve body further has an outlet port formed therein while said manifold body further has an output path formed therein, and said gasket further has an output hole formed therein such that, whether said gasket is disposed in the first orientation or in the second orientation, said outlet port and an entrance of said output path are communicated with each other by way of said output hole.

4. A solenoid valve manifold as claimed in claim 1, wherein said valve body further has an exhaust port formed therein while said manifold body further has an exhaust path formed therein, and said gasket further has an exhaust hole formed therein such that, whether said gasket is disposed in the first orientation or in the second orientation, said exhaust port and an entrance of said exhaust path are communicated with each other by way of said exhaust hole.

* * * * *